United States Patent [19]

Chang

[11] Patent Number: 4,657,435

[45] Date of Patent: Apr. 14, 1987

[54] UNDERWATER TUNNEL CONSTRUCTION

[76] Inventor: Ming Y. Chang, 20 Covered Wagon La., Rolling Hills, Calif. 90274

[21] Appl. No.: 814,047

[22] Filed: Dec. 27, 1985

[51] Int. Cl.[4] ..... E21D 9/00

[52] U.S. Cl. ..... 405/136; 405/146; 405/150; 52/2

[58] Field of Search ..... 405/24, 25, 26, 124, 405/136, 137, 146, 150; 52/2, 2 F

[56] References Cited

U.S. PATENT DOCUMENTS

| | | | |
|---|---|---|---|
| 784,413 | 3/1905 | McBean | 405/136 |
| 1,221,067 | 4/1917 | McBean | 405/136 |
| 3,698,066 | 10/1972 | Cornwell | 405/146 |
| 4,304,084 | 12/1981 | Moreland | 52/2 |
| 4,371,288 | 2/1983 | Borca et al. | 405/150 |

*Primary Examiner*—Cornelius J. Husar
*Assistant Examiner*—Kristina I. Hall

[57] ABSTRACT

A novel method of underwater tunnel construction is provided which comprises the employment of a double-layered flexible mold or form and the introduction of both an inert and a reactive fluid into spacings of the mold so as to produce both the shape and the basic structure of the designated tunnel. Upon consolidation of the reactive fluid, the inert fluid will be withdrawn and air is filled in to provide the tunnel spacing for further finishing work and normal function of the tunnel. When completed, the designated tunnel basically consists of a sandwich-like structural body having a least an inner and an outer layer of impermeable fabrics and sandwiched within these fabrics a relatively thick layer of consolidated mass such as concrete which constitutes the main structure or walls of the tunnel. A second layer of consolidated mass may be provided through the use of a third and outer fabric and the corresponding introduction of the reactive fluid into the enclosed spacing thereof. This provides the lateral strength for the tunnel. Alternatively, the basic tunnel structure may also be erected within a depression pre-excavated on the floor of the watercourse to delete the need for supplementary wall system.

8 Claims, 3 Drawing Figures

UNDERWATER TUNNEL CONSTRUCTION

BACKGROUND OF INVENTION

The present invention relates to a novel method and the corresponding device for the construction of a tunnel-like structure. More specifically, the invention relates to the construction of an underwater vehicle tunnel over the floor of a watercourse such as a river whereby assembly work on site is difficult.

The conventional method of under-river tunnel construction begins with excavation of earth or rock. If the earth or rock is structurally poor, supports must often be placed under the tunnel ceiling, or arch, as the tunnel is being driven. This excavation and ceiling work is the most costly and hazardous operation in the construction. As a general rule, a tunnel under a river is routed a substantial distance away from the riverbed which exaggerates further the total cost of such a structure. On top of this, the need for thorough geological survey, the possible need of driving a pilot tunnel at site, and the requirements of roof support and linings, etc. can all be very expensive operations for the construction of the vehicle tunnel.

I have found that these disadvantages of the conventional under-river tunnel construction can be eliminated by the employment of a flexible, double-layered fabric molding structure (hereinafter referred to as the "flexible mold") laying on and across the riverbed and by the introduction of both an inert fluid and a reactive and solidifiable fluid into the appropriate compartments or spacings of the flexible mold, respectively. Upon the consolidation of the reactive fluid the inert fluid may be withdrawn to provide the basic structure of the underwater tunnel. Hereinafter additional tiling and finishing work inside the tunnel will complete the construction work.

It is therefore one objective of this invention to provide a method for the construction of an underwater tunnel without underground excavation thereof.

It is another objective of this invention to provide a method of underwater construction without on-site assembly work for the basic structure of the instant tunnel.

It is an additional objective of the present invention to provide a method of underwater tunnel construction which conforms to the shape of a depression excavated onto the floor of the watercourse.

It is a further objective of this invention to provide a device which allows the underwater tunnel construction such as that described in the present invention.

These and other objectives of the invention, together with the advantages thereof, will become apparent from the following specifications and appended claims.

SUMMARY OF THE INVENTION

The present invention relates to a novel method for the construction of an underwater tunnel laying directly on the bottom of the water which comprises the use of a flexible and multi-compartment mold defining the designated tunnel and the introduction of both an inert and reactive fluid into the appropriate compartments thereof to form the basic structure of said tunnel. Upon the solidification of the reactive fluid, the inert fluid is withdrawn from the mold t provide the tunnel spacing of said underwater tunnel.

DETAILED DESCRIPTION OF THE INVENTION

Figure 1:
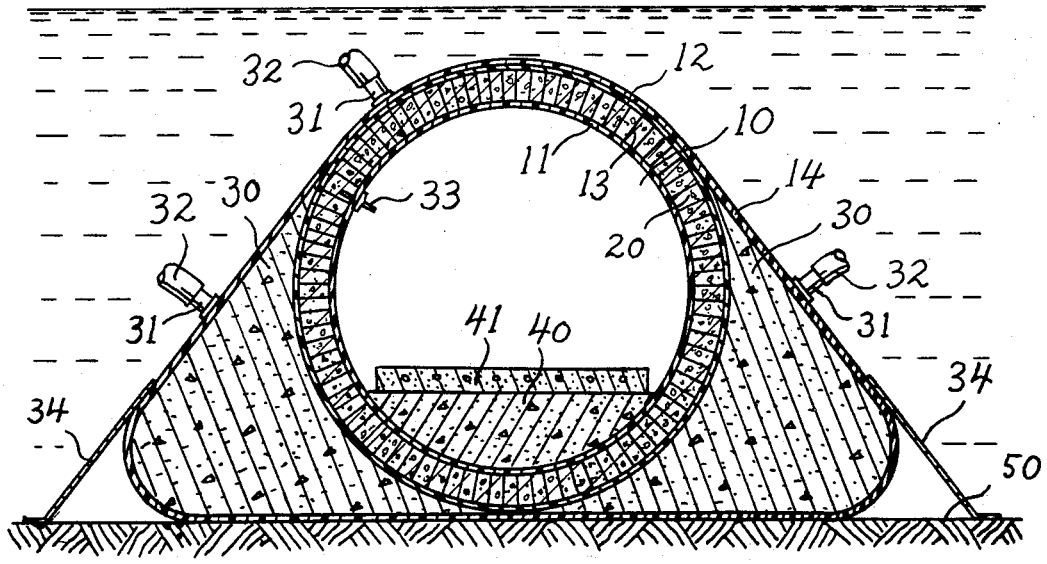
Figure 1A:
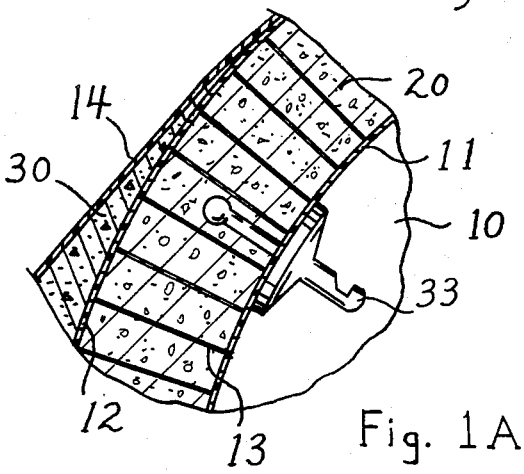
Figure 2:
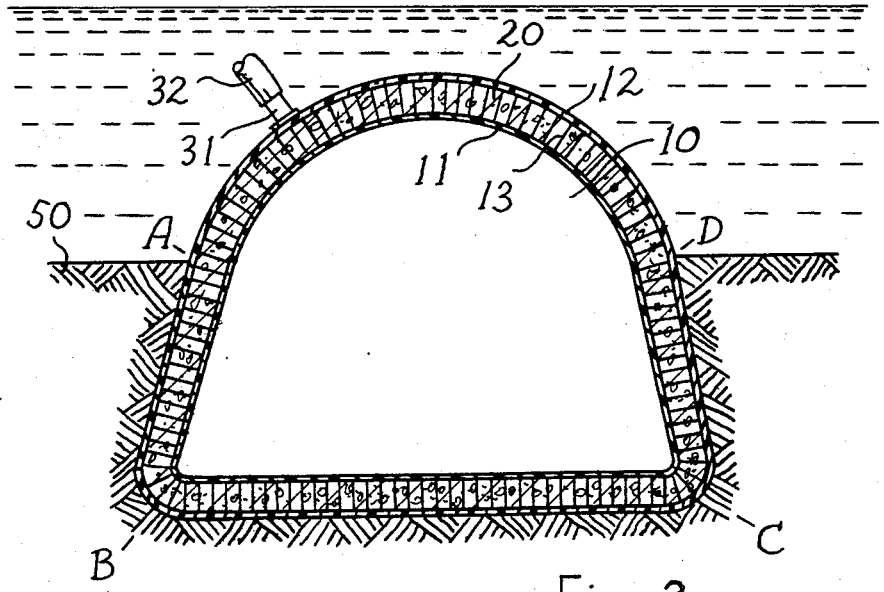

A more complete understanding of the invention will follow from a detailed description of the accompanying drawings wherein:

FIG. 1 is a section view of a tunnel structure of substantially tubular form equipped with an outer supplementary wall structure as well as two internal pavement structures, with FIG. 1A showing the enlarged parts of this figure; and FIG. 2 is a section view of a tunnel structure which conforms to the shape of the pre-excavated depression onto the floor of the watercourse.

On one of the embodiments of this invention as illustrated in FIG. 1 the flexible mold designated for the construction of the underwater tunnel is comprised of a flexible double-layered fabric structure whereby the first layer of fabric 11 is constructed in such a way as to enclose predetermined geometric space 10 such as that of a circular tunnel whenever it is filled up in fullness with an inert fluid. Over the entire outer surface of the fabric 11, except at both terminal ends of the tunnel, is attached a second layer of fabric 12. A plurality of perpendicular yarns or drop threads 13 whose length determines the separation of fabrics 11 and 12, are interconnected between the instant double-layered fabrics. The space enclosed by the first and the second fabrics 11 and 12 is defined as the wall spacing 20 which is designated to admit a reactive fluid to be set and solidified therein. The entire outer surface of the second layer of fabric 12 is enclosed with a third layer of fabric 14 with a circumference considerably larger than the second layer fabric 12. The space 30 enclosed between fabrics 12 and 14 is defined as the supplementary wall spacing. Valve means 31 are provided on the fabric structure to facilitate the introduction and confinement of fluids into the corresponding spacings 10, 20 and 30. Piping means 32 may also be attached to the valves 31 to transport the fluids needed for the construction of the instant tunnel.

Also shown in FIG. 1 are two layers of concrete materials 40 and 41 which are formed in conventional ways after the basic structures of the tunnel are completed and the inert fluid in spacing 10 is withdrawn. The first and base pavement 40 can be plain concrete and the second layer 41 can be steel-reinforced concrete to serve as the pavement of the vehicle tunnel. The function and advantage of these layers will be subsequently elaborated.

Accessory and/or attachment means such as anchoring lugs 33 may be fitted to the flexible mold at appropriate places. As shown in FIGS. 1 and 1A, the lug 33 is adhered at its middle section onto the surface of fabric 11 with one end extruding into the wall spacing 20. When the reactive fluid is filled and solidified in this spacing the corresponding lug will be firmly secured in the matrix of the consolidated wall. Here the lug 33 can be used to affix other equipment to the tunnel. Additional anchoring means 34 may also be attached to the fabric to provide lateral stability on the floor 50 of the watercourse.

The interrelationship of the fabrics 11, 12, 14, the connection yarns 13, and the anchoring lug 33 is shown in greater detail in FIG. 1A.

The flexible mold as shown in FIG. 1 is in the fully erected form, i.e., whenever the tunnel spacing 10 is filled in full with an inert fluid, the wall spacing 20 is filled in full with a reactive fluid and the supplementary wall spacing 30 is filled with the reactive fluid to the designated volume, respectively (for clarity's sake, the reactive fluid filled in the wall spacing 20 is shown as blank in present figures). In other words, the shape of the flexible mold is shown here while the construction of the tunnel is completed at site. Prior to the in situ construction, however, the instant flexible mold is normally kept in the collapsed form. That is, before the introduction of any fluids into the flexible mold, the corresponding spacings 10, 20 and 30 are all void and the fabric structures, being made of flexible materials, do not assume any well-defined shape but collapse into layers of fabrics much like a collapsed air mattress. In this way, the flexible mold can be folded and/or spooled on a reel for the purpose of storage and transportation.

The thickness of the designated tunnel wall, i.e., the separation of the first fabric 11 from the second fabric 12 of the double-layered fabrics, should be such that the mechanical strength of the consolidated wall thereof is at least greater than the maximum compression of the corresponding waterhead whereby the underwater tunnel is located. The total volume of the spacings 20 and 30 inclusive should also be such that the combined weight of the consolidated walls is greater than the total weight of water displaced by the designated tunnel. As an illustrative but non-limiting example, a wall thickness of 1 foot for a designated 25 foot diameter tunnel located in a site of 250 feet depth of water is adequate for the purpose of the present invention. For the same tunnel structure, a third layer of fabric 14 capable of enclosing a volume of V, whereby V=(400 square feet)×(the length of tunnel underwater), is adequate for this tunnel structure, provided that the solidifiable material is concrete.

FIG. 2 depicts another embodiment of the present invention wherein a depression or ditch A-B-C-D on the floor 50 of the watercourse is provided to house the double-layered flexibl mold. Herein the corresponding parts of the mold carry the same identifications as those of FIG. 1. To be noticed is the absence of the third layer of fabric 14, which is no longer necessary because of the application of the floor depression A-B-C-D. The instant mold as shown here is also in the erected form accordingly.

The material which makes up the fabrics and yarns of the above illustrated flexible molds can be any flexible and substantially inextensible and impermeable material such as nylon, PVC and other thermoplastics and/or resin-impregnated fibers or fabrics. A preferable property for such fabrics is a density larger than the water at the site of construction. This will allow the setting of the flexible mold onto the bottom of the water to facilitate the construction of the scheduled tunnel structure.

In accordance with and fulfilling the above stated objectives, one important aspect of this invention resides with the finding that the shape and basic structure of the designated tunnel can be obtained by introducing or inflating the tunnel spacing 10 with an inert fluid such as water and filling the wall and supplementary wall spacings 20 and 30 with a reactive and solidifiable fluid such as freshly mixed concrete or mortar, respectively, and by subsequent withdrawal of the inert fluid from the tunnel spacing 10 after the curing and consolidation of the reactive fluid in the spacings 2 and 30 therein. I have found that as far as the combined weight of the solidified concrete in spacings 20 and 30 is larger than the weight of the water being displaced by the tunnel, the instant structure will stay on the site of the construction. I have also found that as far as the mechanical strength of the solidified tunnel wall is larger than the compression of the in situ waterhead, the tunnel will stay and stand therein even when the inert fluid in the tunnel spacing 10 is withdrawn and replaced by air. The basic structure of the designated tunnel is therefore established.

A second aspect of this invention lies in the finding that by providing a reinforced concrete pavement 41 placed on top of a flat concrete base 40 but not in direct contact to any part of the tunnel wall 11, the tensile stress exerted by the moving vehicles onto the pavement 41 will be dissipated and transmitted through the bases of the tunnel downwardly onto the floor 50 of the watercourse. In this way, very small tensile stress will be encountered by the uppe portion of the tunnel structure which is then adequately handled by the plain concrete. Since these pavements are constructed by conventional means, steel reinforcement is feasible which will increase the overall mechanical strength of the underwater structure.

A further important aspect of the invention lies in the discovery that as far as the circumference or cross-sectional are of the flexible mold is larger than the cavity of the depression A-B-C-D, the erected shape of the lower portion of the designated tunnel structure will conform to the shape of the instant depression and that of the upper portion will concave downwardly at the opening of the depression, A-D, as shown in FIG. 2. That is, whenever the flexible mold is placed inside the depression and then the tunnel spacing 10 is introduced in full with an inert fluid and the wall spacing 20 is filled up with the reactive fluid, a desirable shape conforming to the depression will result, i.e., flat floor and straight walls, as shown in FIG. 2. Upon the solidification of the reactive fluid in spacing 20, the inert fluid in spacing 10 may then be withdrawn and air may be admitted therein. The basic tunnel is then ready for subsequent finishing work to be performed inside the structure. For example, additional pavements, lighting, ventilation, etc. may be laid by the conventional methods.

A still further aspect of the invention resides with the finding that the resulting tunnel structure will withstand the flotation of the water and stay in the depression provided that the excavated walls A-B and C-D of the instant depression are concaved or leaned downwardly a shown in FIG. 2 and provided the summation of the mechanical strength of these excavated walls and the weight of the resulting tunnel thereof is large enough to resist such flotation. By the same token, I found that stronger floor strength will allow a thinner tunnel wall and therefore a lesser amount of concrete to be used for the tunnel structure. Conversely, for floors composed of soft silts or porous sands, the thickness of the tunnel wall 20 or the combination spacings of the tunnel wall and supplementary wall, if any, will have to be so large as to provide adequate weight to balance off the in situ flotation force. Nevertheless, the benefits of a depression are many-fold in addition to combating the flotation. The provision of lateral stability to the tunnel and reduction of the interference with the normal flow pattern of the watercourse are but two pronounced benefits among others.

In accordance with the present invention, a novel method of underwater tunnel construction is provided which comprises the employment of a doublelayered flexible mold or form and the introduction of both an inert and a reactive fluid into the appropriate spacings of the mold so as to produce both the shape and the basic structure of the designated tunnel. Upon consolidation of the reactive fluid, the inert fluid will be withdrawn and air is filled in to provide the tunnel spacing for further finishing work and normal function of the tunnel. When the construction is completed, the designated tunnel basically consists of a sandwich-like structural body having at least an inner and an outer layer of impermeable fabrics and sandwiched within these fabrics a relatively thick layer of consolidated mass such as concrete which constitutes the main structure or walls of the tunnel. Supplementary to this basic tunnel structure, a second layer of consolidated mass may be provided through the use of a third and outer fabric and the corresponding introduction of the reactive fluid into the enclosed spacing thereof. This will provide the lateral strength for the tunnel. Alternatively, the basic tunnel structure may also be erected within a depression pre-excavated on the floor of the watercourse to delete the need for the supplementary wall system. As it is apparent from the compound structure of the tunnel, the impermeable fabrics will provide the water-tightness required by the underwater structure and the sandwiched concrete will provide the mechanical strength and weight to withstand the various forces exerted on the tunnel. In this way, the basic structure of a tunnel will be built over the floor of the water whereby essentially neither assembly work nor underground excavation are required to make such a cross-river tunnel. The cited objectives of the present invention are therefore fulfilled.

According to this invention, a concrete tunnel is provided which basically does not have the conventional reinforcement for the concrete structure. A structure of this type normally possesses adequate compression strength but is relatively weak in tensile strength. Considering the fact that the major external stress exerted in a underwater structure is the compression but not the tension stress, the instant structure of this invention is mechanically adequate for the normal use of a tunnel. This is particularly true for those structures equipped with reinforced concrete pavement as shown in FIG. 1 and also true for those erected in a preexcavated depression. Nevertheless in case that additional tensile strength is required, a layer of reinforced concrete lining may be furnished to the tunnel structure immediately after the withdrawal of the inert fluid from spacing 10. The construction of this reinforced concrete layer can be carried out by conventional methods and the anchoring lugs 33 provided on the flexible mold can be conveniently used for this purpose.

It should be pointed out herewith that for the construction of an underwater tunnel according to this invention, the first layer fabric 11 of the double-layered fabric structure should be made to possess a simple geometric shape such as a circular tubing and to enclose an isolated spacing 10 from the outside atmosphere. The second layer of fabric 12 should be made to cover and enclose the entire longitudinal tubular surface of the first layer of fabric 11 but not to cover both terminal ends of the designated tunnel. These ends are therefore the entrance and exit openings of the tunnel. Valve means to introduce the inert fluid into the tunnel spacing 10 are conveniently equipped at these ends. Other accessories such as temporary door and exhaust pipings, etc. may also be equipped herewith. When the erection of the tunnel is completed, these portions of the fabrics at the terminal ends are to be cut off from the consolidated tunnel structure to expose the tunnel spacing 10 to the outside atmosphere.

It is also to be noted that the flexible mold as described above may be assembled in a factory or other more convenient places nearby the construction site of the designated tunnel. The flexible mold thus assembled can be tested and examined by inflating the appropriate spacings with air and/or water to produce its designated shape, for example, pumping air into spacing 10 and water into spacings 20 and 30. Any leaks or imperfection of the assembly work may be corrected at this stage, after which the air or water in the respective spacings can be evacuated from the flexible mold to collapse the same into a pile of shapeless fabrics. The mold may then be folded and packaged or spooled onto a reel for storage or for shipment.

The in situ construction of the tunnel structure begins with the unfolding or dereeling of the flexible mold and extending and laying it onto the designated site, i.e., the appropriate floor or the pre-dug depression of the watercourse. The introduction of the fluids can be carried out by pumping the various fluids through the attached pipelines 32 and valves 31 into the appropriate spacings 10, 20 and 30. To produce the desirable shape of the tunnel structure, each of the molding spacings should be filled to the predetermined volumes until the following pumping pressures are reached in the corresponding spacings: (1) the pump pressure for the tunnel spacing 10 should be equal to or greater than the maximum waterhead plus the unit weight of the reactive fluids in both the wall spacing and supplementary wall spacing; (2) the pumping pressure for the wall spacing 20 should be at least 15 psi greater than the final pumping pressure of the tunnel spacing 10; (3) the final pumping pressure for the supplementary wall spacing should at least equal the maximum waterhead at site.

It is readily appreciated from the foregoing description that there are provided a novel and convenient method of tunnel construction and a specifically assembled so-called "flexible mold" to facilitate such construction. The method is especially suitable for the construction of a "tunnel across the river." Although specific embodiments of the invention are given in this application, it should be understood that the scope and practice of the invention do include modifications and variations to extend the application of the method without department from the spirit of the preceding specifications and the appended claims.

I claim:

1. A method for the construction of a basic tunnel structure comprising:

first introducing a flexible mold made of double-layered fabrics to contain various compartments of the designated tunnel structure;

then pumping an inert fluid into the compartment representing the tunnel spacing of the structure to produce a simple geometric shape of same;

followed by pumping a reactive fluid into the compartments representing the wall spacings of said tunnel structure until the latter are filled to the predetermined volumes;

allowing the reactive fluid to be cured and solidified in said wall spacings to a rigid structure for said tunnel;

and finally withdrawing said inert fluid from the tunnel spacing to evacuate same for subsequent finishing work and usage of the tunnel structure.

2. A method for the construction of a basic tunnel structure as claimed in claim 1 whereby the site of said structure is located on the floor of a watercourse such as a river or a lake.

3. A method for the construction of a basic tunnel structure as claimed in claim 1, in which said flexible mold is placed into a depression preexcavated on the floor of the watercourse to contain and withhold said tunnel structure.

4. A method for the construction of a tunnel structure as claimed in claim 1, in which additional pavements and/or reinforced linings are fabricated inside the tunnel structure upon the withdrawal of the inert fluid from said tunnel spacing thereof.

5. A method for constructing a tunnel structure as claimed in claim 1 wherein said inert fluid comprises the water at designated site of construction and said reactive fluid comprises freshly prepared concrete mixture or substances of the same nature, respectively.

6. A device applicable for the construction of a tunnel structure according to claim 1 comprising:

a double-layered fabric structure made of flexible, inextensible and impermeable material in which the first layer of fabric encloses a predetermined simple geometric spacing referred to as the tunnel spacing;

a second layer of fabric enclosing largely the first layer of fabric to provide there between a so-called wall spacing;

a plurality of equal length of yarns interconnecting said first fabric to said second fabric to define the separation of these two fabrics and the thickness of the designated tunnel wall;

and necessary valve and attachments to facilitate the introduction of various fluids into said spacings respectively and to affixed said fabric structure over the site of construction thereof.

7. A device useful for the construction of a tunnel structure as claimed in claim 6, in which said flexible, inextensible and impermeable material is a thermoplastic such as nylon, PVC or like material.

8. A device useful for the construction of a tunnel structure as claimed in claim 6 whereby a third layer of fabric and the corresponding valve means are provided to cove basically the surface of the second layer fabric and enclose there between a third and supplementary wall spacing for the designated structure.

* * * * *